US005446348A

United States Patent [19]

Michalek et al.

[11] Patent Number: 5,446,348

[45] Date of Patent: Aug. 29, 1995

[54] APPARATUS FOR PROVIDING IGNITION TO A GAS TURBINE ENGINE AND METHOD OF SHORT CIRCUIT DETECTION

[75] Inventors: Jan K. Michalek; Ebrahim B. Shahrodi, both of Newark, Ohio

[73] Assignee: Michalek Engineering Group, Inc., Newark, Ohio

[21] Appl. No.: 178,420

[22] Filed: Jan. 6, 1994

[51] Int. Cl.[6] ..... H05B 37/02

[52] U.S. Cl. ..... 315/209 SC; 315/209 CD; 315/227 R; 315/242; 315/291

[58] Field of Search ..... 315/209 SC, 209 R, 307, 315/308, 291, 242, 227 R, 209 CD

[56] References Cited

U.S. PATENT DOCUMENTS

| | | | |
|---|---|---|---|
| 3,824,429 | 7/1974 | Davalillo | 315/209 SC |
| 4,739,185 | 4/1988 | Lee et al. | 315/209 SC |
| 5,065,073 | 11/1991 | Frus | 315/209 R |

*Primary Examiner*—Robert J. Pascal
*Assistant Examiner*—Reginald A. Ratliff
*Attorney, Agent, or Firm*—George Wolken, Jr.

[57] ABSTRACT

A solid state, bipolar, ignition exciter for gas turbine engines is described for delivering high energy pulses to one or more igniter plugs. A storage capacitor is charged with typically 12 to 20 Joules of stored energy and discharged through a solid state switch and a series-connected ignitor plug. The solid state switch consists of a plurality of silicon controlled rectifiers (SCRs) connected in series, in combination with other components connected in parallel with each SCR. Protection is provided against transients in voltage by means of resistance-capacitance snubber circuits connected in parallel with each SCR. Protection is provided against transients in current by means of inductance connected externally, and in series with, the solid state switch. Protection is provided against damage from reverse voltages by means of a reverse current path through the solid state switch, typically by means of a diode or series-connected diode chain connected in parallel with the SCRs. Thus, the solid state switch of the present invention conducts current alternately in forward and reverse directions once the SCRs are switched to their conducting state, providing bipolar current flow to the igniter plug. Controlling means and short circuit protection circuits are also described.

29 Claims, 6 Drawing Sheets

APPARATUS FOR PROVIDING IGNITION TO A GAS TURBINE ENGINE AND METHOD OF SHORT CIRCUIT DETECTION

BACKGROUND OF INVENTION

This invention relates generally to the field of ignition systems for gas turbine engines. More particularly, the present invention relates to a bipolar ignition system capable of delivering high-energy pulses to one or more gas turbine igniter plugs for reliable operation of the turbine in severe environments.

Gas turbine engines have found application in numerous areas of commerce and technology, from their use as jet aircraft engines to providing power for pumps and compressors in remote oil field or offshore locations. One characteristic of all such turbine engines is that, once started, the combustion occurring within the turbine is intended to be self-sustaining. That is, an ignition system for gas turbine engines is needed only for starting the engine. Once started, the combustion within the turbine is normally self-sustaining until the turbine is intentionally shut off by the operator or turns off spontaneously due to accidental variations of fuel or air supply or several other causes. [The igniter can also be operated continuously, as typically done for internal combustion engines, and occasionally necessary for gas turbine engines as well.] However, especially in airborne applications, it is very important that the engine be capable of reliable restarting under possibly severe conditions of temperature, pressure, humidity, fuel composition, etc. The circuitry for providing reliable, high-energy pulses for starting or restarting gas turbine engines is the subject of the present invention.

The basic operation of gas turbine igniter circuits typically involves the charging of a storage capacitor from a source of electrical power, followed by the sudden discharge of the capacitor through a spark-generating device ("igniter plug") inserted in the combustion region of the turbine. The sudden release of the energy stored in the storage capacitor through the igniter plug generates a spark for the ignition of the vaporized fuel adjacent thereto. In contrast to igniter circuits for driving spark plugs in typical Otto cycle internal combustion engines, turbine igniters are commonly required to deliver much higher energies per pulse through the igniter plug spark.

While simply described, the specific implementation for gas turbine igniters is subject to several technical challenges, due to the severe and variable environments in which the igniter system is required to operate, and the requirement of high energy delivery through the igniter plug for ideal turbine ignition systems.

One of the major technical challenges has involved the switch for discharging the energy in the storage capacitor rapidly through the igniter plug . This switch must be capable of rapidly turning on for discharge, but not suffer damage by the high currents and energies it must carry over relatively short periods of time. Currents carried by this discharge switch will typically exceed a thousand amps at peak values. This discharge switch typically must carry numerous repetitions of this pulse to insure reliable ignition of the gas turbine engine.

A common approach to the design of the discharge switch has centered around a gas discharge tube as the switching mechanism for rapid discharge of the storage capacitor (not to be confused with the spark generated by the igniter plug for ignition of the fuel within the turbine itself). This gas discharge switch commonly involves electrodes separated by a region of gas. When the critical discharge voltage across the electrodes is reached, a spark jumps the gap between the electrodes, leading to large current flow across the gap. The gas pressure and composition, the electrode geometry, spacing and material, all contribute in determining the voltage at which the gas discharge tube conducts and delivers the energy stored in the capacitor to the igniter plug. However, a serious drawback to the gas discharge tube has been its relatively short service lifetime, increasing maintenance costs for turbine operation. A more serious problem in many applications is the problem of a failed gas discharge tube and unreliable starting of the turbine. For these reasons, reliable solid state components have been finding wide usage in igniter circuits.

Most commonly, silicon controlled rectifiers ("SCRs") have been used to replace the gas discharge tube as the basic switching component for discharging the primary energy storage capacitor. In essence, an SCR is a semiconductor switch, capable of carrying current in one direction after it has been switched on by a "trigger" or "gate" pulse. Once switched to the conducting state, a typical SCR will remain conducting in its "forward" or conducting direction until switched off by interruption of current flow or forced reverse current flow. Typical SCRs will remain in the conducting state even in the absence of gating pulses although certain SCRs can be returned to the non-conducting state ("switched off") by negative gating pulses.

SCRs have proven to be much more reliable in actual operation than gas discharge tubes as a means for quickly discharging the energy in the capacitor through the igniter plug. As a solid state device, typical SCRs are much more tolerant of extreme conditions of temperature, humidity, etc. in which such igniter circuits are required to work.

However, use of SCRs in igniter circuits has brought additional challenges to the circuit designer. In general, SCRs must be protected from damage by excessive voltages in both forward and reverse directions: from excessively rapid changes in the voltages applied to the SCR and the currents passing therethrough, and from attempting to carry excessive currents through each SCR. All of this is to be accomplished while delivering maximum energy to the igniter plug. Various approaches to these problems have been taken.

A standard approach to SCR circuit technology is to use several SCRs in series to divide the applied voltages over several SCR's, thereby reducing the voltage any single SCR is required to endure. This has the drawback that failure of any one SCR in the series by means of an anode-cathode short circuit, will lead to overvoltages on all other SCR's in the series. Thus, failure of a single SCR by this mode will result in failure of all SCRs in the series and failure of the total device. Lozito el. al. (U.S. Pat. No. 5,053,913) have tackled this problem by requiring every SCR in the series to be capable of carrying the entire, undivided applied voltages. This redundancy certainly increases reliability in the event of an anode-cathode short occurring in the SCR. However, the increased costs of redundant SCR components in the circuit must also be considered, coupled with the increased voltage ratings (and costs) required of each separate SCR.

It is likewise common in the applications of SCRs to provide protection from rapidly changing voltages and currents by "snubber" circuits. Typically, a resistance-capacitance snubber circuit will be used in parallel with each SCR to provide a protective path around the SCR for rapidly changing voltages. In addition, inductance is typically provided in the SCR circuit to damp excessive changes in currents. Such techniques are well known "textbook" approaches to the use of SCR devices and also employed in the present invention.

However, the task for the designer of ignition exciter circuits is to provide maximum energy to the igniter plug with the most cost efficient, reliable circuit. Many designers have thus been led to consider "unipolar" ignition devices in which current flows through the igniter plug in one direction only. The advantage of such devices lies in part in that current is applied in only one direction to the SCR switch. Thus, the SCR switching circuits merely need to discharge the capacitor through the igniter plug, but need not withstand reverse voltages (for example, see the work for Frus, U.S. Pat. Nos. 5,065,073; 5,148,084; 5,245,252). However, (according to Frus) the resulting current delivered to the igniter plug is most effective when "shaped" in a variety of ways by means of a saturable inductors interposed between the SCR switch and the igniter plug.

The present invention has as its basic approach to the application of maximum energy to the igniter plug. The present invention typically applies 12 to 20 Joules of energy through the igniter plug. The present invention uses a bipolar circuit in which current flows through the igniter plug in both directions with peak values (typically) in excess of 2,000 amps. As a result, no wave-shaping or conditioning circuitry is required between the SCR switch and the igniter plug. However, the use of bipolar ignition current leads to the application during half of the current cycle of significant reverse voltages to the SCR switch. The protection provided for the SCRs during this phase of the current flow cycle is a major feature of the present invention. In addition, the present invention includes (but is not limited to) a short-circuit protection mechanism to prevent discharge of the fully charged storage capacitor through a defective or shorted igniter plug.

SUMMARY AND OBJECTS OF THE INVENTION

The present invention relates to a bipolar, solid state ignition system capable of delivering high-energy pulses to one or more igniter plugs. A storage capacitor is charged with typically 12 to 20 Joules of stored energy and discharged through a solid state switch. The solid state switch typically consists of SCRs connected in series in combination with other components connected in parallel therewith. Protection is provided against transients in voltage by means of resistance-capacitance snubber circuits connected in parallel with each SCR. Protection is provided against transients in current by means of inductance connected externally, and in series with the solid state switch. Protection is provided against damage from reverse voltages by means of a reverse current path through the solid state switch typically by means of a diode or series-connected diode chain connected in parallel with the SCRs.

A primary object of the present invention is to provide an apparatus for delivery of high-energy pulses to engine igniter plugs without the use of gas discharge tubes as switching devices.

Another object of the present invention is to provide an apparatus for delivery of high-energy pulses to engine igniter plugs in a bipolar manner.

Yet another object of the present invention is to provide an apparatus for delivery of high-energy pulses to engine igniter plugs in a bipolar manner with protection of solid state components from reverse voltages.

Another object of the present invention is to provide an apparatus for delivery of high-energy pulses sequentially to more than one engine igniter plug.

Yet another object of the present invention is to provide an apparatus for delivery of high-energy pulses to engine igniter plugs including circuitry for detection of short circuits and disabling capacitor discharge should a short circuit be detected.

DESCRIPTION OF PREFERRED EMBODIMENTS

Figure 1:
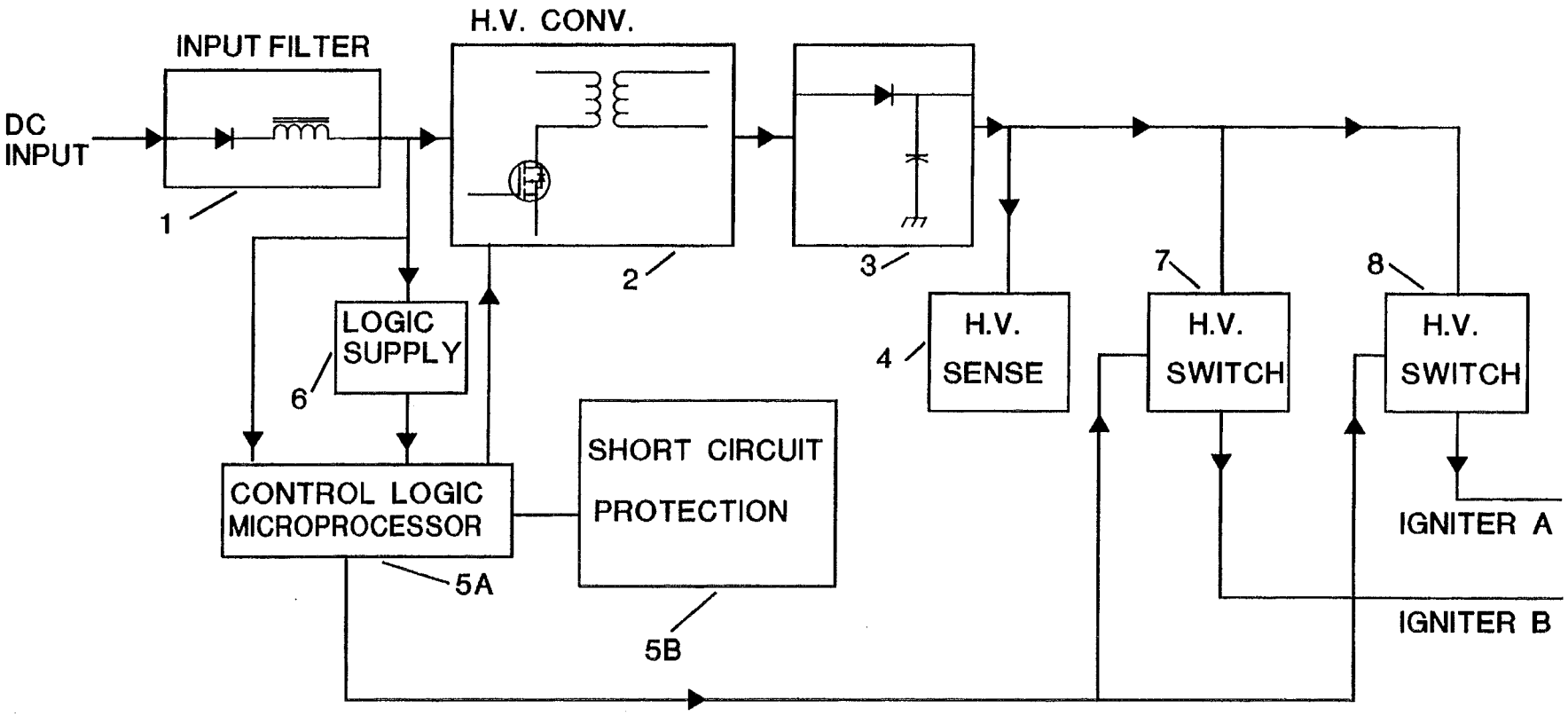
FIG. 1. Block diagram of an embodiment of the present invention as it would typically be used to drive two igniter plugs.

FIG. 1 is a block schematic diagram of an igniter of the general form of the present invention. We show in FIG. 1 an igniter circuit of the present invention as it would be used to drive two igniter plugs. However, the same basic circuitry, as modified in ways well understood by the those having ordinary skills in the field, could be used to drive one, two or more igniter plugs. It is envisioned that up to 18 igniter plugs would be driven by circuitry of the present invention with only minor modifications.

We first give a description of the block diagram of FIG. 1, pointing out in general terms the functions of each component block. We then will focus on a detailed description of each component block of the igniter system and describe the detailed functioning of each. It is understood throughout that the blocks and components are the embodiments presently preferred by the inventors and are not intended to limit or to exclude equivalent methods of performing the same circuit functions as those methods may be well known in the art.

DC input voltage of typically 18 to 28 volts is applied to input filter, 1. The source of such voltage is not shown in FIG. 1, and can be supplied by any convenient source of DC voltage such as rectified AC, batteries, etc. The basic function of input filter is to provide certain smoothing of the input and to protect the circuits (typically computers, other components or control circuits) external to the ignition exciter from noise generated by the ignition exciter itself. Thus, diodes, inductors, capacitors and other filtering devices are provided in filter 1 to protect components external to the ignition exciter from noise generated by the igniter itself and confine noise within the igniter circuits where it may be , and commonly is, generated in connection with the high-energy igniter spark.

It is important to note that the present invention does not require regulated DC input. That is, the DC input to filter, 1, can vary throughout the range specified (18 to 28 volts DC) in an unregulated manner and the present apparatus will still continue functioning.

From input filter, 1, the DC voltage passes to a step-up high voltage converter, 2. Typically the voltage step-up function is performed by means of step-up transformers on pulsed DC yielding pulsed DC voltages in the range from typically 2.1 to 2.7 KV for the present invention. Converter, 2, also contains the means for pulsing the DC input voltage to the step-up transformer as described in detail when the specific circuits of converter, 2, are described below.

The high voltage filter, 3, accepts the stepped-up voltage from converter, 2, provides additional filtering and smoothing, and pumps energy into the main storage capacitor (or capacitors) for later discharge through the igniter plug. The present invention typically will store 12 to 20 Joules of energy in the capacitor. In actual operation it is often convenient to use a plurality of capacitors connected in parallel to store the energy required to drive the igniter plug (or plugs). However, for economy of language we will refer simply to "storage capacitor" to indicate at least one capacitor for storing the energy to be delivered to the igniter plugs.

The high voltage developed across the main storage capacitor contained in 3 is sensed by a high voltage sensing circuit, 4. When the voltage developed across the main storage capacitor has reached the desired level (which is predetermined but can be altered within the present circuitry to meet the energy discharge requirements of the particular igniter plug or operating conditions), the control logic, 5A, generates the triggering pulse to the appropriate high voltage switch, 7 or 8. Power supply, 6, is conveniently used to provide power to the control circuitry directly from the DC input.

As we describe in detail below, the control logic of the present circuit generates alternate triggering pulses for switch 7 and switch 8 (typically at 1 second intervals), leading to alternative sparking from an igniter at a rate twice the firing rate of each high-voltage switch, 7 or 8. Persons of ordinary skill in the art can easily generalize or modify the circuitry of the present invention to handle numbers of igniter plugs different from 2. It is merely necessary to alter the control logic to supply triggering pulses to a different number of switches from control logic, 5A, while ensuring that the main storage capacitor has time to charge to the desired level between discharging through any switch. The circuitry described herein is typically designed to handle up to 18 independent switches and igniter plugs, although different numbers can easily be used within the present design.

One embodiment of the present invention includes an optional feature for short circuit protection. The function of this circuit, shown as 5B in FIG. 1, is to prevent firing of the full capacitor charge through any of the igniter plugs if any plug is shorted (perhaps by contact with an operator), We give an overview here of the operation of this protection circuit, 5B, the full operation of which is described in detail below as would typically be implemented in the present invention.

Essentially, the protection circuit, 5B, senses the voltage developed across the main storage capacitor. When this voltage reaches a level well below full charge (typically, 400 volts in the present embodiment), a signal is sent from protection circuit, 5B, through the control logic circuitry, 5A, to cause all solid state switches to fire. The triggering voltage across the main storage capacitor is chosen low enough that for properly functional igniter plugs without short circuits, no spark will be developed and negligible discharge of the main storage capacitor will occur. 400 volts is an acceptable triggering voltage for the protection circuit-of the present invention.

Once the protection circuit fires the triggering pulses, the voltage across the main storage capacitor is remeasured. If significant voltage change has occurred (say a drop from 400 to 300 volts), this is strong evidence of a serious problem in the igniter circuit; perhaps a short in the igniter plug or in the igniter circuit; an operator or equipment in contact with the tip of the igniter plug; or possibly other causes. If such a significant voltage drop is measured, capacitor charging and firing is disabled. The purpose of this protection circuit is to test, at substantially reduced voltages, certain aspects of the igniter plug and circuit before proceeding to full capacitor charging and firing. While certainly not capable of detecting all possible faults in the igniter plug and circuit, the protection method of the present invention will provide significant protection and safety from an important class of failures.

The above method of short circuit protection is a useful safety feature capable of incorporation into many types of ignition exciters, unipolar as well as bipolar. It is necessary merely that the switch causing the discharge (or attempted discharge) of the main energy storage capacitor can be caused to become conducting by external means of control. Solid state switches in which externally supplied triggering pulses are employed to make the switch conducting are clearly one type of switch meeting this criterion. Other types of switches could be used in different applications as would be obvious in the art.

Observing no significant discharge of the storage capacitor with such attempted pre-discharge is clearly one particular case of the above short circuit test. A straight forward generalization would be to the case in which a known leakage of current from the main storage capacitor is expected under normal operating conditions. In this case, the second voltage measurement across the main storage capacitor would merely need to test the measured voltage across the main storage capacitor against the expected known leakage to determine if excessive leakage (hence, strong evidence of an electrical malfunction) is present.

Figure 2:
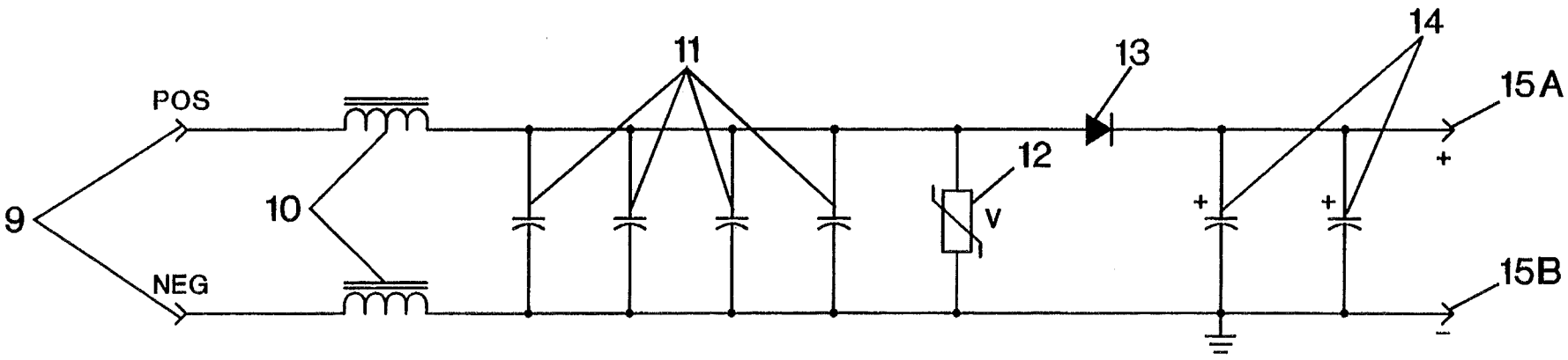
FIG. 2. Schematic circuit diagram of an embodiment of the input filtering portion of the present invention.

FIG. 2 shows in more detail the input filter, 1, shown in block diagram form as 1, in FIG. 1. Unfiltered (and typically unregulated) DC input having voltage from typically 18 to 24 volts DC is supplied to terminals 9 in positive and negative polarity as noted. The source of such input is immaterial to the functioning of the present ignition exciter. Typically, it would be a form of rectified AC, DC from a separate DC power supply, or DC supplied from storage batteries. This DC input is delivered through inductors 10, to a plurality of capacitors connected in parallel, 11 in order to accomplish a certain amount of smoothing of the current and voltage.

Device, 12, in FIG. 2 is typically a variable resistor, included to protect the igniter circuitry from any high voltage spikes which may be generated outside the igniter and appear at input terminals, 9. Variable resistor, 12, is typically a voltage-sensitive resistor which has very high resistance until the voltage appearing across the terminals of, 12 reaches a critical value. At such critical voltage value, the resistance of, 12, drops markedly, leading to a direct current path across the input terminals, 9. Typically, 12 would be a metal oxide varistor in which, absent high voltage spikes appearing across input terminals, 9, varistor 12 would have very high resistance and essentially have no effect on the input filter shown in FIG. 2. However, in the presence of high voltage, the resistance of varistor 12 would decrease markedly, thereby preventing such unwanted and unexpected high voltages from damaging the components of the igniter itself.

The input filter also typically contains a diode, 13 the main purpose of which is to protect the igniter circuit. Diode, 13, serves to ensure that the polarity of voltages at terminals, 15A and 15B, remain positive and negative respectively (as shown in FIG. 2), despite accidental reversal of the polarity applied at terminals, 9, (typically, by operator error).

Finally, capacitors, 14, are typically used to provide final voltage smoothing before filtered DC voltage appears at terminals having positive and negative polarities as shown. The negative polarity is typically taken as ground.

Figure 3:
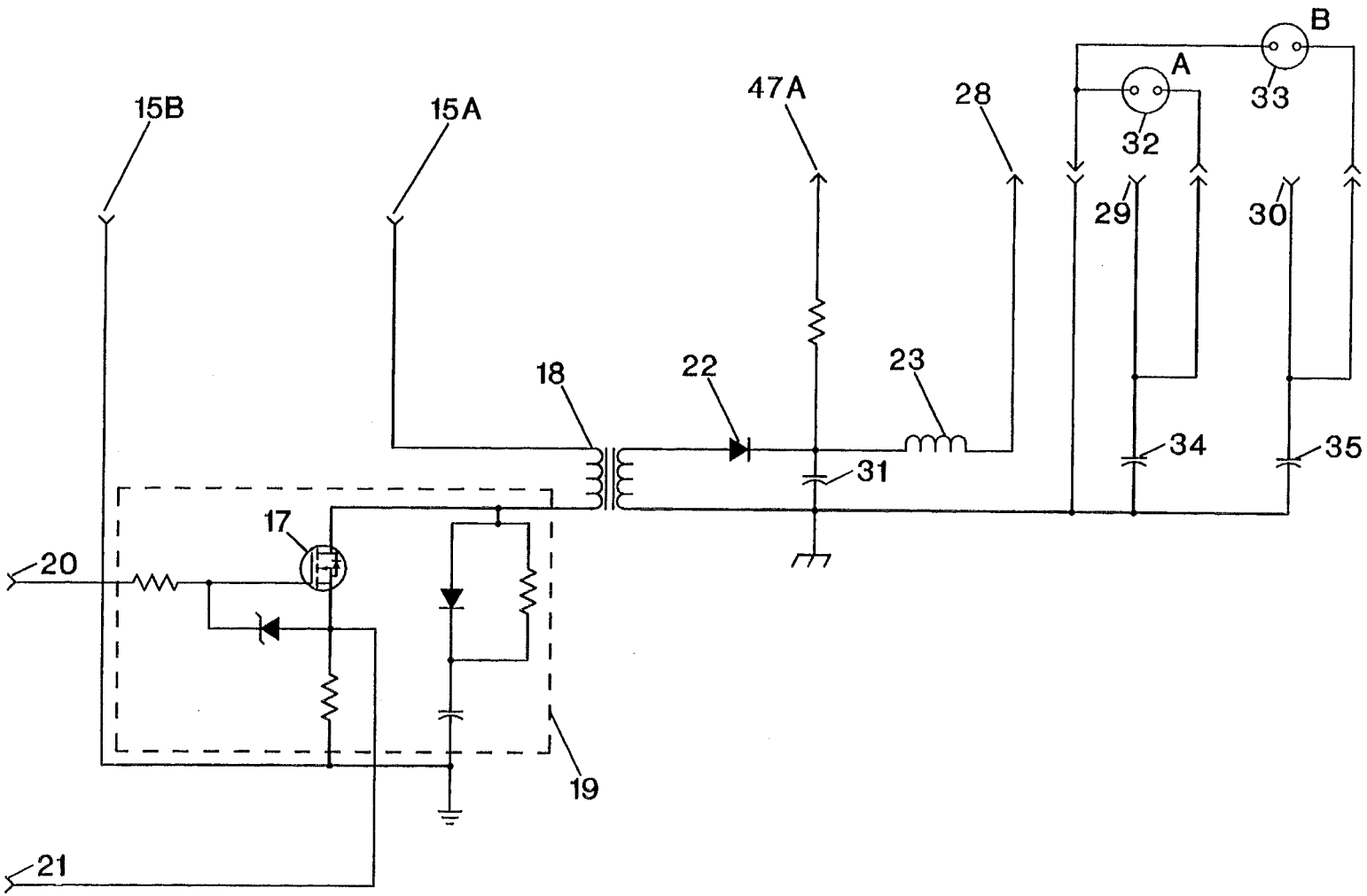
FIG. 3. Schematic circuit diagram of an embodiment of the high voltage present invention conversion, storage capacitor, and capacitor charging portions of the FIG. 4. Schematic circuit diagram of an embodiment of the solid state switching portions of the present invention as would be typically arranged for driving two igniter plugs through two solid state switches.

FIG. 3 shows the detailed circuitry for the high voltage converter, shown as block 2 in FIG. 1 of the generic type commonly known as a "flyback converter". The voltage input at terminals 15A and 15B is stepped-up by means of transformer 18 to a value of typically 2,100 to 2,700 volts. However, for the transformer to function the DC input voltage at terminals 15A and 15B must be pulsed. This is accomplished by transistor 17 and the associated circuitry, 19.

Inputs 20 and 21 to transistor 17 cause it to turn on and off according to a specific duty cycle which may be easily altered by the control portion of the circuit. When transistor 17 is in its conducting state, current from positive terminal, 15A, has a path to ground through this transistor, 17. When transistor, 17, is non-conducting, DC input voltage from positive terminal, 15A, has no path to ground and, hence, no current is delivered through transformer 18. The net effect of controlling transistor 17 by means of input pulses from 20 and 21 is to pulse the DC input at terminal 15A synchronously with pulses applied to 20. Such pulsed DC input is then stepped-up by transformer 18. Other components shown in block 19 on FIG. 3 are standard circuit components ("snubbers") for protecting the transistor 17 and controlling devices supplying terminals 20 and 21 from noise and other transients generated by the igniter circuitry. Such snubbers can be found in many variations and in numerous standard circuit references. The embodiment shown as 19 in FIG. 3 is presently preferred but not intended to exclude equivalents well known to those with ordinary skill in the field.

The high voltage converter also will typically contain a diode, 22, to rectify the output from step-up transformer 18. Inductor, 23, is also typically included in filter circuit, 3, to suppress fluctuations in current.

The basic operation of the ignition exciter can be understood in very general terms from the information presented thus far. In essence, the charging of the main storage capacitor, 31, is controlled by controlling the on-off "duty cycle" of transistor 17 by means of pulses supplied through 20 and 21. Causing transistor 17 to be conducting will cause energy to be stored in the magnetic field associated with transformer, 18, while switching off transistor 17 leads to the charging of capacitor 31 from the energy stored in the magnetic field of transformer, 18. Microprocessor control of the duty cycle of transistor, 17, thus allows detailed control of the timing of the charging of the main storage capacitor 31.

The main storage capacitor, 31 is discharged through igniter plugs 32 or 33 by means of solid state switches. The detailed operation of the solid state switches is described below. However, in FIG. 3, a solid state switch would be connected between terminals 28 and 29 (for the sparking of plug 32) and between 28 and 30 for the sparking of plug 33. Simply stated, the solid state switch between 28 and 29, when open, prevents the negative side of capacitor 31 from finding a path to the positive side of 31 through the igniter plug 32 or by any other means. When a connection is made between 28 and 29, current flows through igniter plug 32, through the switch from 28 to 29, and through inductor 23 to complete the discharging of capacitor 31. A completely analogous procedure is followed by the solid state switch connecting 28 and 30 for the discharge of capacitor 31 through igniter plug 33.

Capacitors 34 and 35 are inserted into the circuit to provide protection for the solid state switches from high voltage transients, giving a direct path to ground through 34 and 35 respectively, bypassing the switching devices. Inductor 23 provides protection from rapid fluctuations in current.

The operation of the present circuit is readily controlled by control of the triggering pulses to the solid state switches and to transistor 17. Control of transistor 17 controls the charging of the main storage capacitor, 31. Control of the solid state switches controls discharge of capacitor 31 through one or more igniter plugs. The present circuit illustrates the example for two igniter plugs, 32 and 33. However, the use of the present circuit to drive one, or more than two igniter plugs is apparent to one having ordinary skill in the art.

Figure 4:
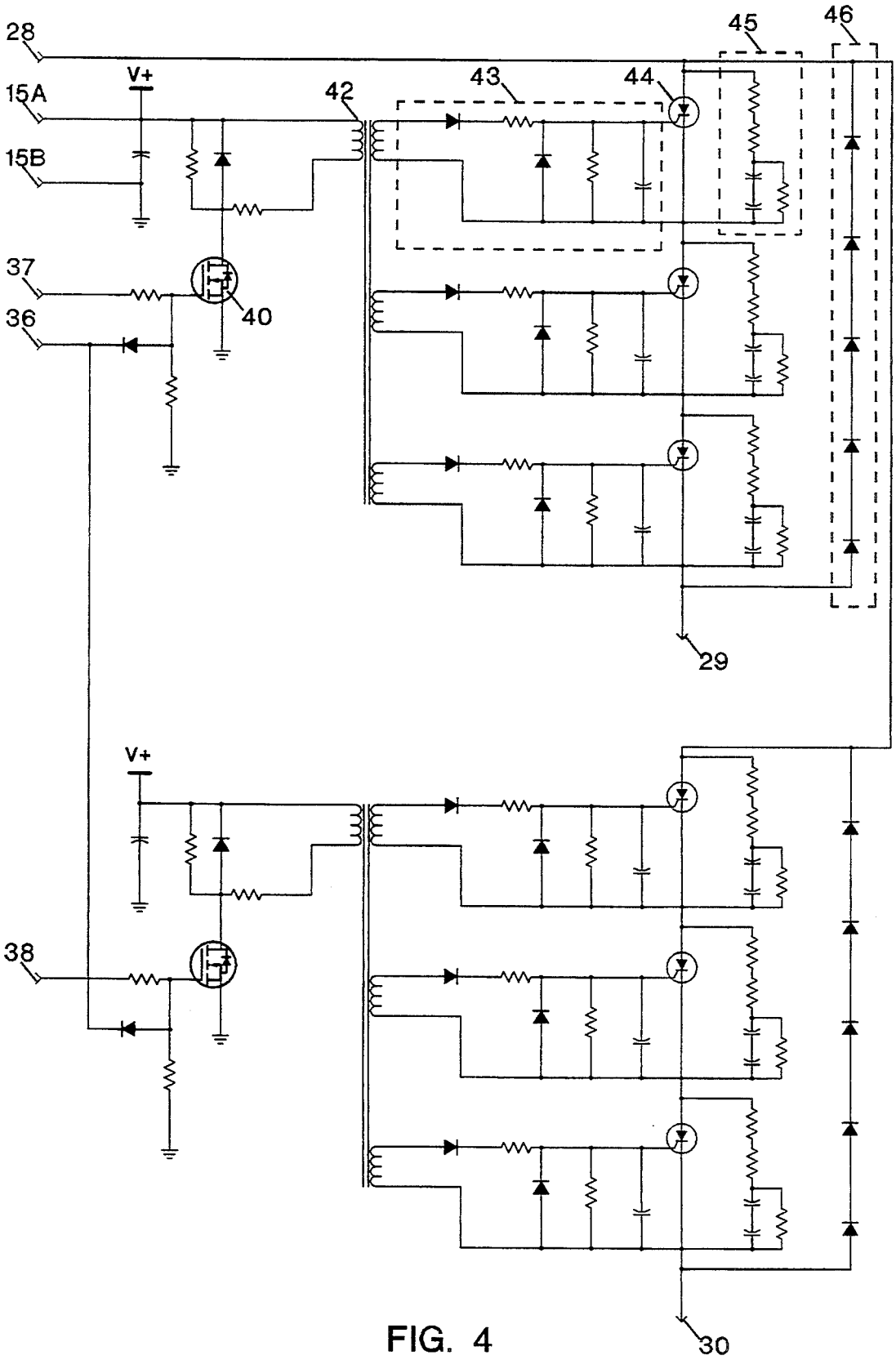

FIG. 4 shows the solid state switches as connected between terminals 28 and 29, or between 28 and 30 respectively. The switches are identical so,-for economy of description, we will describe in detail the switch driving igniter plug 32.

Input voltage (typically 24 volts DC) provides power to the switch gating (or triggering) circuit through 40. Caring pulses provided from the logic circuits (described in detail in the following), are delivered to the solid state switch through terminal 37. Caring clock pulses are delivered to 36. As is typical in the operation of solid state switches, the gating pulse applied to 37 causes transistor, 40 to become conductive. The pulsing of transistor 40 by means of gating pulses delivered through 37 causes pulsed DC current to be delivered to the primary side of transformer, 42. Outputs from the secondary windings of transformer 42 are rectified and filtered by circuitry 43, as is commonly done in the application of SCRs as components of solid state switches.

A common problem in the application of gating pulses to SCRs is the saturation of transformer, 42. The present circuit overcomes this problem by the application of a high-frequency carrier wave along with the gating pulses. This carrier wave is generated by oscillator, 48 shown on FIG. 5, and applied to the primary windings of transformer 42 by means of terminal 36. The combination of high-frequency carrier wave and the gating pulse applied at terminal 37 through transistor 40 acts to hinder saturation of the primary windings of transformer 42 during the gating pulse. Typically, the carrier wave can be any convenient value in the range approximately 80 to 120 KHz, determined by the natural frequency of the circuit components used.

The present circuit uses a series chain of SCRs, 44, to divide the voltage appearing across the switch between several SCRs, thereby avoiding overloading any single SCR. This is in contrast to the work of Lozito cited above in which each SCR is capable of bearing the entire voltage applied to the entire switch. The present invention follows more conventional use in which a series connection of SCRs is used to reduce the voltage required to be withstood by each SCR. However, it may be prudent in certain applications to allow for the failure of a single SCR by choosing SCR components of the solid state switch such that loss of one from a chain of N SCRs does not result in failure of the entire chain. That is, each SCR in the chain of N should be capable of withstanding forward voltage of $\{N/[N-1]\}$ times the normal forward voltage. It is straight forward to generalize this relationship to allow for failure of M components in a series connection of N components: $N>M$ as $\{N/[N-M]\}$.

A snubber circuit, 45, is included in parallel to each SCR to absorb and dissipate transients in voltages which may appear across the terminals of an SCR leading to damage. The circuit of Lozito uses inductors as part of each snubber circuit to absorb transients in current. However, the present design finds it more convenient to use a single inductor, 23, in series with the complete solid state switching circuit to absorb current transients.

Multiple capacitors and resistors in series are shown in snubber 45 merely to reduce the voltage applied to any single component, thereby reducing the size and cost. Single components can also be employed whenever desired with no essential change to the functioning of the circuit.

It is important to note that the output from the cathode of the final SCR in the series is connected directly by 29 or 30 to the igniter plug, 32 or 33 respectively. In contrast to the work of Frus cited above, there is no need in the present circuit for a saturable inductor, or indeed for any network at all, to be in the circuit between the SCRs and the igniter plug, for waveshaping or for any other purpose. The present circuit uses a direct cable connection from the SCR chain directly to the igniter plug, as clearly shown in FIGS. 3 and 4.

However, the basic approach of the present invention is to provide maximum energy to the igniter plug. Thus, the present circuit uses a bipolar current through the igniter plug, flowing alternately in positive and negative directions through the igniter plug and the solid state switching circuit. To avoid damage to the SCRs by excessive application of reverse voltages, a reverse diode ("freewheeling diode"), 46, is connected in parallel with the SCR's to carry the reverse current. In actual practice, it is convenient to use a series connection of several diodes so the full applied voltage is divided among several diodes, not requiring any single diode to withstand the full applied voltage. However, the net effect on the circuit is essentially the same whether a single or a chain of freewheeling diodes is used. Thus, in bipolar operation current flows alternately in forward and reverse (positive and negative) directions through the solid state switch and the igniter plug in series connection therewith. Current in the forward direction through the solid state switch is carried by the SCRs, 44, in their conducting state. Current in the reverse direction through the solid state switch is carried by diodes, 46.

In the present embodiment it is believed that freewheeling diodes are the best method for providing for reverse current flow through the solid state switch while bypassing the SCRs. However, any other means for permitting unidirectional current flow around the SCRs would be acceptable for the proper functioning of the total solid state switch. For example, a series of SCRs (and associated snubber, gating and other circuits) could be used in the reverse direction from SCR, 44. With simultaneous gating of both forward and reverse SCRs, the bidirectional current flow required of the total solid state switch would be achieved.

Thus, in operation the main storage capacitor, 31 will be charged to the proper level. The solid state switch will be "fired" by the application of a series of triggering pulses to the SCIs by means of 37 or 38. The SCR's remain conducting in one direction, carrying the positive half-cycle of the current from capacitor 31 to the connected igniter plug, 32 or 33 for the entire duration of the spark (and typically well beyond). The current during the reverse portion of the bipolar cycle is carried by diodes 46, thereby avoiding excessive reverse voltages on the SCRs.

Figure 5:
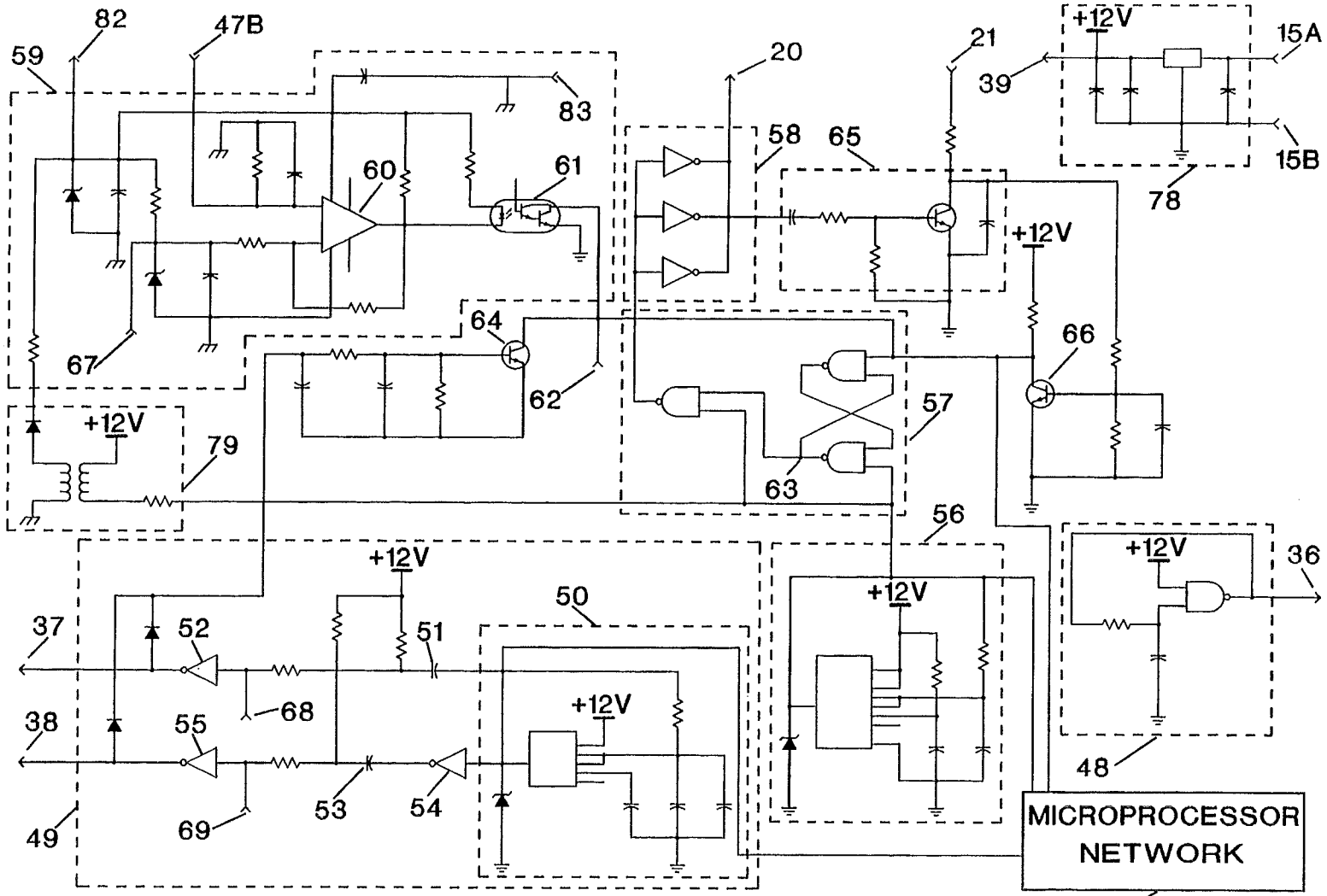
FIG. 5. Schematic circuit diagram of an embodiment of the logical control portion of the present invention (excluding short circuit protection circuitry).

FIG. 5 shows the details of the control circuitry which controls the charging of the capacitor and the triggering of the solid state switches.

Circuit 49 generates the gating pulses for solid state switches 7 and 8 in FIG. 1. The use of a different number of solid state switches would necessitate using a different gate generator circuit, 49, having different frequency and output characteristics. However, for purposes of illustration of the present invention in a concrete fashion, we will continue to explain in detail the case of two solid state switches driving two igniter plugs.

The design of the present igniter circuit generates a spark in each igniter plug at one second intervals; each plug firing 0.5 seconds following the firing of the other plug. As noted elsewhere, different timing circuits can be used, subject to the restriction that the main storage capacitor, have sufficient time between firings (of any plug drawing energy therefrom) to charge to the desired extent for delivery of the appropriate amount of energy to the igniter plug.

Oscillator, 50, is selected herein to be a 1 Hz oscillator for supplying substantially square wave gating pulses to the two solid state switches alternately at 0.5 sec intervals. Capacitor 51 and inverter 52 generate a gating pulse from the leading edge of the output wave from oscillator 50. Capacitor 53 and inverters 54 and 55 generate a gating pulse from the trailing edge of the output wave from oscillator 50. Thus, the gating pulses delivered to 37 and 38 will be one-half cycle out of phase, leading to the firing of the solid state switches (and, hence, sparking of the igniter plugs) at 0.5 second intervals.

Oscillator circuit, 56 is chosen for the present invention to operate at typically 10 KHz. This oscillator is the driver for the charging circuit delivering energy to the main storage capacitor, 31. The 10 KHz signal from 56 goes to flip-flop circuit 57, thence to an inverter buffer, 58, and finally through terminal 20 to turn on transistor 17 in FIG. 3. Thus, whenever oscillator, 56, is generating a signal, transistor, 17, is conducting, and charge is being stored in transformer, 18, for later delivery to the main storage capacitor, 31, when transistor, 17, becomes non-conducting. However, we still need to describe the control circuitry for inhibiting the capacitor-charging circuits when required.

In addition, the output from oscillator, 56, is used to drive the transformer of circuit, 79. The secondary of this transformer (and the associated diode) provides an isolated voltage source for the 5 volt DC power supply at 82 and 83.

The high voltage developed on the main storage capacitor, 31, is monitored through terminal 47A on FIG. 3, through resistor 80 on FIG. 3, and 47B of FIG. 5. Circuit 59 on FIG. 5 is the main high voltage control circuit. The high voltage sensed across storage capacitor, 31 is compared (typically, following a step-down by a known ratio, as in circuit 59) with a predetermined value at 67 by means of comparator, 60. When the capacitor voltage meets or exceeds the predetermined value, optocoupler, 61 becomes conducting, drawing to ground node 62. Causing node 62 to have ground potential causes the potential at node 63 to be at high due to the NAND gates in the flip-flop circuit, 57. This disables the circuit sending a pulse to transistor, 17, thereby stopping charging of capacitor 31. The optocoupler is to insure adequate isolation between the high voltage circuitry (and chassis ground) and the logic circuitry (and logic ground). Transformers or another device could be used in place of the optocoupler, but the optocoupler is the device presently preferred on the basis of size, cost and performance.

Full charge of capacitor, 31, is just one condition under which further charging of the capacitor will be inhibited. Another condition used in the present circuit is the generation of a trigger pulse to any of the SCR switches. That is, whenever an SCI switch is triggered to be conducting, charging of storage capacitor, 31, ceases while the SCRs (or the diodes, 46, for reverse current flow) conduct energy to the igniter plug. This is accomplished through transistor 64, which becomes conducting whenever a triggering pulse is sent to either SCR switch. A conducting transistor, 64, causes the potential at point 62 to be ground. As above, grounding of point 62 disables the charge pumping circuitry.

Yet another condition causing the charging of the storage capacitor, 31 to cease is if the current flowing in the charge pumping circuit exceeds a certain level. When transistor 17 in FIG. 3 is conducting, current flows through resistor 17A in FIG. 3. The voltage developed across the resistor 17A is sensed by the control circuit through terminal 21 in FIG. 3 and FIG. 5. When this current flow exceeds a predetermined value, transistor 66 becomes conducting, pulling node 62 to ground, thereby switching off the charge pump as before.

The network 65 disables the functioning of transistor 66 at the start of the application of gating pulses at 20 thereby allowing a momentary current peak at the start of the gating pulses.

FIG. 5 also contains a linear power supply, 78, to use typically 24 volts DC input at terminals 15A and 15B to develop 12 volts DC. 12 volts DC is required at several points throughout the circuitry described herein and noted in conventional manner as "12V". It is also convenient, to deliver this 12 volts DC through terminal 39.

We also show on FIG. 5 a microprocessor, 96. The circuitry as described thus far will function in a more limited manner without the microprocessor, 96. That is, the circuit of FIG. 5 is quite operational without microprocessor, 96, but in a fashion limiting external control of the circuitry. With microprocessor, 96, connected as shown in FIG. 5, software control can introduce much more flexibility into operation of the present device.

Figure 6:
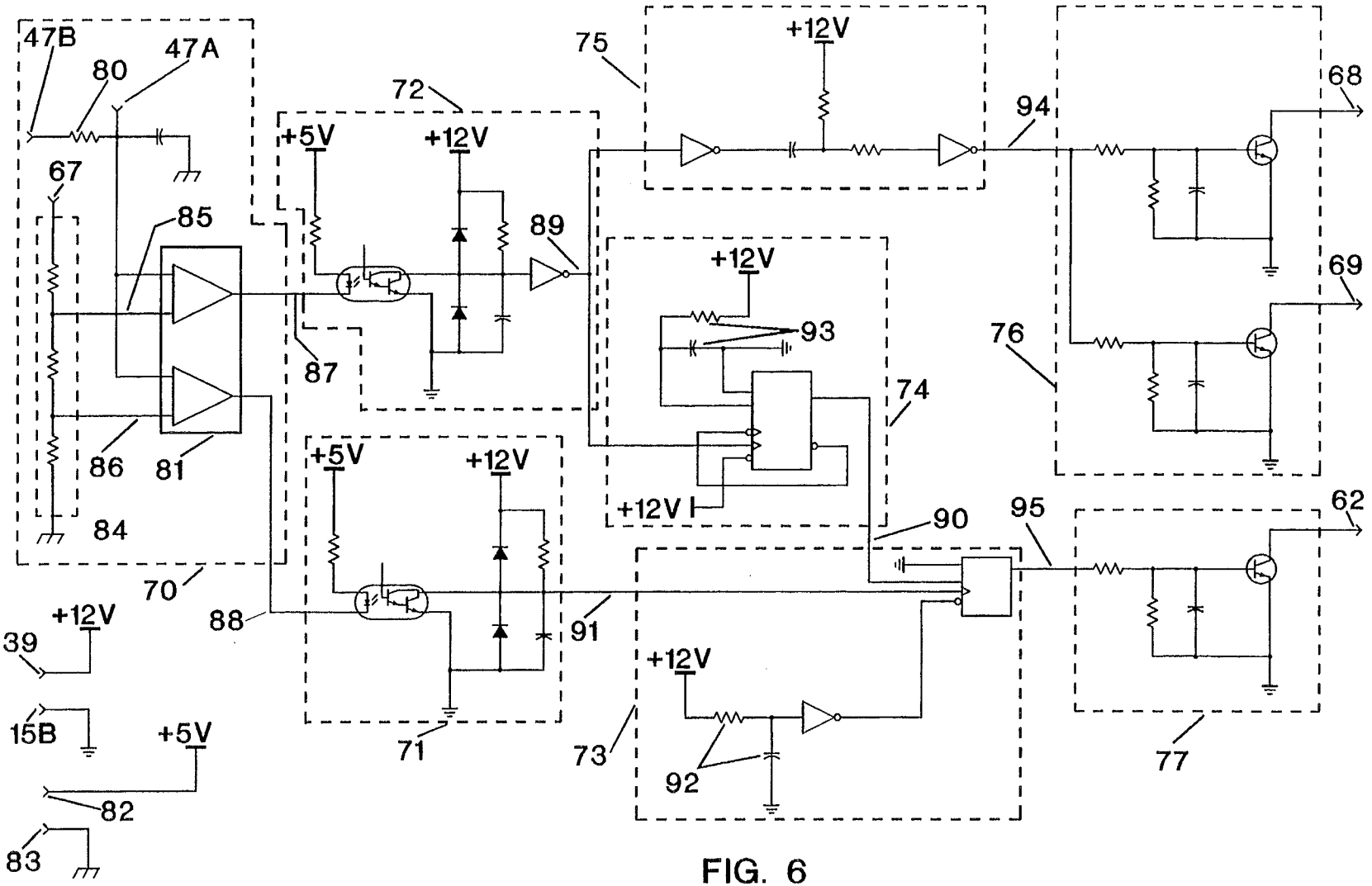
FIG. 6. Schematic circuit diagram of an embodiment of the short circuit protection portion of the logic control circuitry of the present invention.
Figure 3:
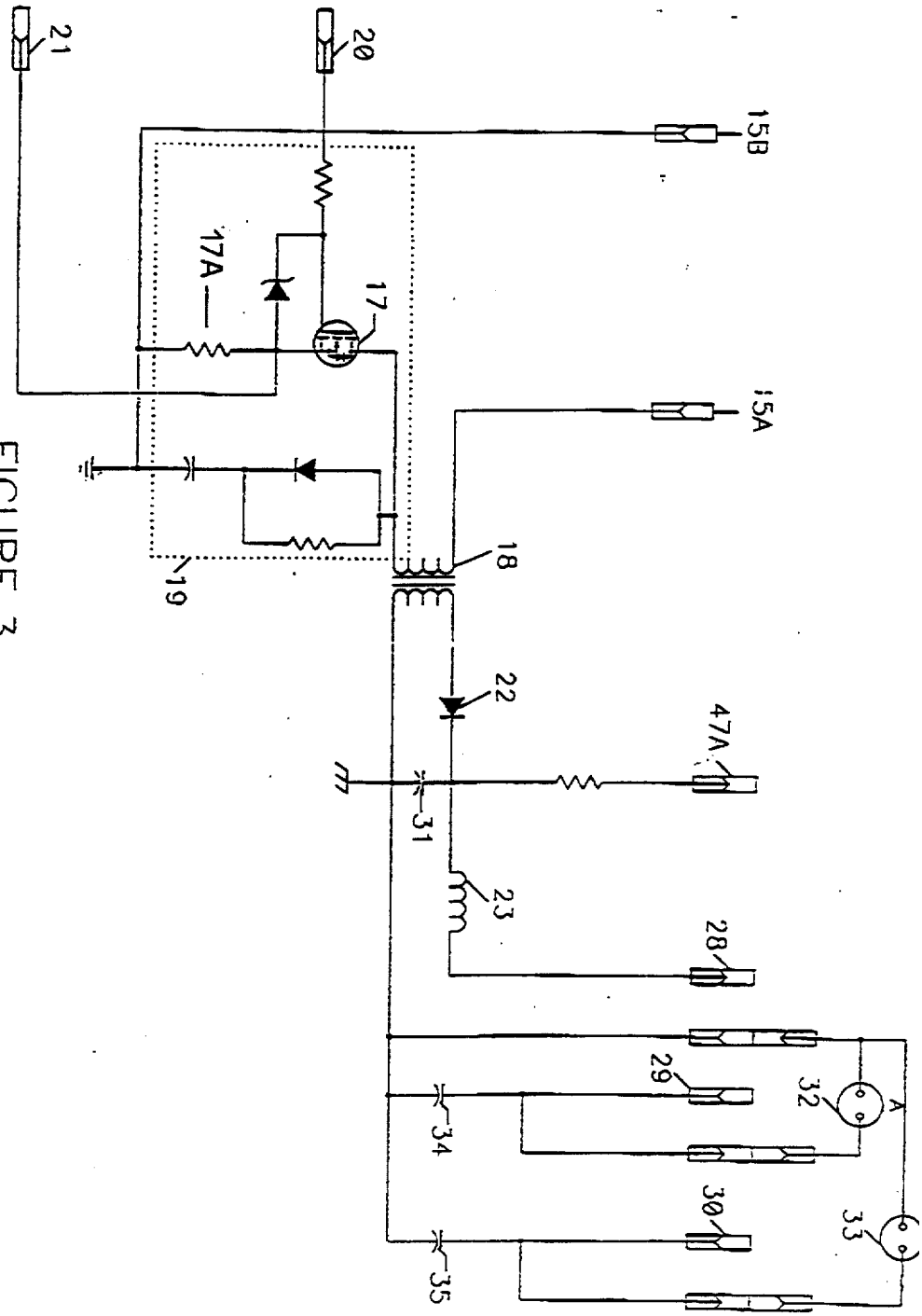

We show in FIG. 6 one embodiment of the short circuit protection shown as 5B in FIG. 1. In the network 70, the voltage developed across storage capacitor, 31, is sensed through terminals 47A and 47B and scaled down by resistor 80. This capacitor voltage is delivered to the input terminals of two comparators, 81. A reference voltage is delivered to terminal 67 and reduced by passage through resistor network, 84. An upper reference level (typically 400 volts) is delivered to one comparator through input 85. This is the level at which the test for possible short circuit in the firing circuit or igniter plug is to begin.

When voltage from the main storage capacitor delivered thorough 47A exceeds the reference voltage at 85, the output from one comparator at 87 becomes low. Passing through a typical isolation network, 72, including an optocoupler, the output of the inverter at 89 becomes high. This "low to high" transition at point 89 causes network 74 (a "one-shot network" as is commonly known in the field) to produce a single pulse at the output, 90, of network 74. The width of this pulse is determined by the values of resistance and capacitance chosen for components 93. The signal at 90 is provided as input to network 73 (typically a "latch network" maintaining its state until changed by further input signals). The output from 73 at 95 is normally held in the low state which corresponds to the state at terminal 62 allowing the capacitor to continue charging ("enable state of the charge pump" following typical terminology).

Output at 89 is also used for input to one shot network 75 producing gating pulses at terminal 94 (typically 1 millisecond "ms" pulses for the present device). During the gating pulse at terminal 94, both transistors in network 76 torn on, causing terminals 68 and 69 to attain their low voltage (ground) state. Causing 68 and 69 to go low, generates pulses through inverters 52 and 55 (in FIG. 5) respectively. Delivery of gating pulses through 37 and 38 causes both solid state switches in FIG. 4 to be switched on. However, since the voltage in the storage capacitor is relatively low compared to its fully charged state (typically 400 volts compared to at least 2,100 volts (no spark should be developed in properly functioning igniter plugs or igniter circuitry. Thus, under normal operating conditions, the storage capacitor, 31 will remain charged at approximately 400 volts following gating of both (or whatever number is employed) solid state switches.

Terminal 86 provides a reference voltage through network 84 at a value lower than the reference voltage at 85. Typically, in the present device, reference voltage 85 is chosen to be 400 volts while reference voltage 86 would be 300 volts. If the igniter plug is defective or shorted, or if another short circuit exists in the igniter circuit, the storage capacitor 31 will discharge upon application of gating pulses at 94. That is, the storage capacitor will discharge rapidly compared to the typically 1 ms gating pulse applied at 94. This discharge will cause the reference voltage at 86 to exceed the capacitor voltage as it now is sensed through terminal 47A.

Thus output of the second comparator in network 81 goes to its low voltage state, giving low voltage at 88. Low voltage at 88 causes the output, 91, of isolation network, 71 to go to its low state. Since the high to low transition of signal at 91 occurs when input, 90, to latch circuit 73 is high, the output, 91 from the latch circuit, 73 goes and stays in its high state. This turns on transistor network, 77, attached to terminal 62, keeping terminal 62 at its low voltage state. As noted above, terminal 62 in its low state disables further charging of the storage capacitor, 31. The disablement of capacitor charging continues indefinitely until the exciter is turned off and restarred after the short circuit condition has been corrected.

The resistor-capacitor network of 92 insures that, upon the initial turning on of power to the unit, the output 95 is at its low state, thus resetting the latch output 95.

We claim:

1. A bipolar apparatus for igniting a gas turbine engine by means of an alternating forward and reverse current flow comprising:

a) a storage capacitor capable of storing at least 0.1 Joules of energy;

b) a power supply for charging said storage capacitor to a predetermined voltage;

c) an igniter plug producing a spark in response to energy discharged from said capacitor through said igniter plug;

d) a solid state switch connected in series with said igniter plug and said storage capacitor, wherein said solid state switch, in its conducting state, conducts current alternately in forward and reverse directions therethrough;

e) a signal generator applying triggering signals to said solid state switch, wherein said triggering signals are applied to said solid state switch responsive to the state of charge of said storage capacitor.

2. An apparatus as in claim 1 wherein said solid state switch comprises:

a) a silicon controlled rectifier (SCR);

b) a snubber network comprising resistive and capacitive components connected in parallel, and wherein said snubber network is connected in parallel with said SCR;

c) a diode conducting in a reverse direction from said SCR, said diode connected in parallel with said SCR and in parallel with said snubber network.

3. An apparatus as in claim 1 wherein said solid state switch comprises:

a) a plurality of silicon controlled rectifiers (SCRs) connected in series;

b) a plurality of snubber networks comprising resistive and capacitive components connected in parallel, and wherein each of said snubber networks is connected in parallel with each of said SCRs;

c) a plurality of diodes connected in series, said series-connected diodes conducting in a reverse direction from said series-connected SCRs, and said series-connected diodes connected in parallel with said series-connected SCRs.

4. An apparatus as in claim 1 wherein said storage capacitor stores energy in the range of approximately 12 to 20 Joules.

5. An apparatus as in claim 3 wherein said series-connected silicon controlled rectifiers (SCRs) withstand sufficient voltages such that failure of at least one of said SCRs permits the remaining series-connected SCRs to remain functional.

6. An apparatus as in claim 3 wherein said series-connected diodes withstand sufficient voltages such that failure of at least one of said diodes permits the remaining series-connected diodes to remain functional.

7. An apparatus as in claim 1 wherein said power supply is an unregulated DC power source.

8. An apparatus as in claim 7 wherein said unregulated DC power source supplies voltages from approximately 18 to 28 volts DC.

9. An apparatus as in claim 1 further comprising a voltage regulating network controlling the voltage on said storage capacitor.

10. An apparatus as in claim 1 further comprising a flyback DC to DC converter developing high voltage across said storage capacitor.

11. An apparatus as in claim 10 wherein said converter develops volts in the range approximately 2,100 to 2,700 volts DC.

12. An apparatus as in claim 1 further comprising a timing circuit applying said triggering signals to said solid state switch at a predetermined rate.

13. An apparatus as in claim 2 further comprising an inductor connected in series with said SCR.

14. An apparatus as in claim 3 further comprising an inductor connected in series with said series-connected SCRs.

15. An apparatus as in claim 1 further comprising a network generating a high frequency carrier and superimposing said high frequency carrier on said triggering signals.

16. An apparatus as in claim 15 wherein said high frequency carrier has frequency approximately 80 to 120 KHz.

17. An apparatus as in claim 4 wherein said triggering signals are applied simultaneously to each of said series-connected SCRs by means of a network which applies said simultaneous triggering signals although at least one SCR becomes nonfunctional.

18. An apparatus as in claim 10 wherein said flyback converter comprises:

a) circuit for sensing the voltage of said storage capacitor:

b) circuit for regulating the charging rate of said storage capacitor in response to said capacitor voltage to a rate not stressing components of said charging circuit.

19. An apparatus as in claim 1 further comprising:

a) a short circuit detection network in the discharge circuit of said storage capacitor;

b) a circuit preventing discharge of said storage capacitor whenever said short circuit detection network detects a short.

20. An apparatus as in claim 19 wherein said short circuit detection network comprises:

a) a first comparator circuit comparing the voltage across said storage capacitor with an upper reference voltage:

b) a triggering circuit applying triggering signals to said solid state switch when said first comparator detects that said storage capacitor voltage exceeds said upper reference voltage:

c) a second comparator circuit comparing the voltage across said storage capacitor with a lower reference voltage;

and wherein said discharge preventing circuit comprises;

d) a circuit for disabling further charging and firing of said storage capacitor when said second comparator detects that said capacitor voltage does not exceed said lower reference voltage.

21. An apparatus as in claim 20 wherein said upper reference voltage is approximately 400 volts and said lower reference voltage is approximately 300 volts.

22. A bipolar apparatus for igniting a gas turbine engine by means of an alternating forward and reverse current flow comprising:

a) a storage capacitor capable of storing at least 0.1 Joules of energy;

b) a power supply for charging said storage capacitor to a predetermined voltage;

c) a plurality of igniter plugs, each producing a spark in response to energy discharged from said capacitor sequentially through each of said igniter plugs;

d) a plurality of solid state switches each of said switches connected in series with one of said igniter plug and said storage capacitor, wherein each of said solid state switches, in its conducting state, conducts current alternately in forward and reverse directions therethrough;

e) a signal generator applying triggering signals sequentially to each of said solid state switches, wherein said triggering signals are applied sequentially to each of said solid state switches responsive to the state of charge of said storage capacitor.

23. An apparatus as in claim 22 wherein said apparatus comprises two igniter plugs.

24. An apparatus as in claim 23 wherein said signal generator applies said triggering signals sequentially to said two igniter plugs at intervals of approximately 0.5 seconds.

25. An apparatus as in claim 22 further comprising:

a) a first comparator circuit comparing the voltage across said storage capacitor with an upper reference voltage;

b) a triggering circuit applying triggering signals simultaneously to each of said solid state switches when said first comparator detects that said storage capacitor voltage exceeds said upper reference voltage;

c) a second comparator circuit comparing the voltage across said storage capacitor with a lower reference voltage;

d) a circuit for disabling further charging and firing of said storage capacitor when said second comparator detects that said capacitor voltage does not exceed said lower reference voltage.

26. An apparatus as in claim 12 further comprising a microprocessor for the control of said triggering signals.

27. An apparatus as in claim 9 wherein said voltage regulating network comprises microprocessor control of said voltage on said storage capacitor.

28. A method for detecting electrical malfunction in a gas turbine ignition exciter comprising the steps of:

a) sensing the first voltage developed across the main energy storage capacitor of said ignition exciter;

b) causing the switching device discharging said storage capacitor to become conductive at a first voltage across said storage capacitor less than that voltage at which significant discharge of energy from said storage capacitor would occur in properly functioning discharge circuits;

c) sensing the second voltage developed across said storage capacitor;

d) continuing the normal operation of said ignition exciter if said first voltage and said second voltage are substantially equal.

29. A method for detecting electrical malfunction in a gas turbine ignition exciter comprising the steps of:

a) sensing the first voltage developed across the main energy storage capacitor of said ignition exciter;

b) causing the switching device discharging said storage capacitor to become conductive at a first voltage across said storage capacitor less than that voltage at which full discharge of energy from said storage capacitor would occur in properly functioning discharge circuits;

c) sensing the second voltage developed across said storage capacitor;

d) continuing the normal operation of said ignition exciter if said first voltage and said second voltage differ by substantially no more than a predetermined amount indicative of properly functioning discharge circuits.

* * * * *

UNITED STATES PATENT AND TRADEMARK OFFICE

CERTIFICATE OF CORRECTION

PATENT NO. : 5,446,348
DATED : August 29, 1995
INVENTOR(S) : Jan K. Michalek, et al It is certified that error appears in the above-indentified patent and that said Letters Patent is hereby corrected as shown below:

Figure 3: Cancel Figure 3 and replace with the Substitute Figure 3 attached hereto.

Col 1, line 55: Cancel "in" and replace with "from".

Col 7, line 26: Insert immediately following "terminals", the phrase "15A and 15B".

Col 8, line 49: Cancel "switch gating (or triggering)" and replace with "gating (or triggering switch".

Col 8, line 49: Cancel "40" and replace with "37".

Col 11, line 16: Cancel "Fig. 3" the second occurrence on this line, and replace with "Fig. 6.".

Col 11, line 68: Cancel ","

Col 14, line 36 (Claim 17): Cancel "claim 4", and replace with "claim 3".

Col 3, line 27, Cancel "to"

Col. 4, lines 23-25, Cancel the existing description of Fig 3 in lines 23-25 inclusive, and replace with "Fig. 3. Schematic circuit diagram of an embodiment of the high voltage conversion, storage capacitor, and capacitor charging portions of the present invention."

Col 5, line 65: Cancel "," and replace with "."

Col 8, line 50: Cancel "Caring" and replace with "Gating".

Col 8, lies 52: Cancel "Caring" and replace with "Gating".

UNITED STATES PATENT AND TRADEMARK OFFICE

CERTIFICATE OF CORRECTION

PATENT NO. : 5,446,348
DATED : August 29, 1995
INVENTOR(S) : Jan K. Michalek, et al It is certified that error appears in the above-indentified patent and that said Letters Patent is hereby corrected as shown below:

Col 10, line 23: Cancel "SCIs", and replace with "SCRs".

Col 11, line 39: Cancel "SCI" and replace with "SCR".

Col 12, line 43: Cancel "torn", and replace with "turn"

Col 12, line 51: Cancel " ( " , and replace with " ) ".

Col 13, line 13: Cancel "restarred", and replace with "restarted".

Signed and Sealed this

Thirty-first Day of December, 1996

*Attest:*

Bruce Lehman

BRUCE LEHMAN

*Attesting Officer*

*Commissioner of Patents and Trademarks*